United States Patent [19]

Slasinski

[11] Patent Number: 4,897,912

[45] Date of Patent: Feb. 6, 1990

[54] METHOD AND APPARATUS FOR FORMING JOINTS

[75] Inventor: Arthur L. Slasinski, Harper Woods, Mich.

[73] Assignee: Weldex, Inc., Warren, Mich.

[21] Appl. No.: 326,160

[22] Filed: Mar. 20, 1989

Related U.S. Application Data

[62] Division of Ser. No. 71,451, Jul. 8, 1987, Pat. No. 4,856,316.

[51] Int. Cl.[4] ..... B23P 11/00

[52] U.S. Cl. ..... 29/432.2; 29/521; 72/354

[58] Field of Search ..... 29/432, 432.1, 432.2, 29/521; 72/354, 450, 451

[56] References Cited

U.S. PATENT DOCUMENTS

| | | | |
|---|---|---|---|
| 3,091,843 | 6/1963 | Double et al. | 29/432 |
| 3,885,299 | 5/1975 | Hafner | 29/432.2 X |
| 3,900,937 | 8/1975 | Schleicher | 29/21.1 X |
| 4,208,776 | 6/1980 | Schleicher | 29/432 X |
| 4,658,502 | 4/1987 | Eckold et al. | 29/432.1 X |
| 4,716,755 | 1/1988 | Bulso, Jr. et al. | 72/354 X |
| 4,760,634 | 8/1988 | Rapp | 29/521 X |

*Primary Examiner*—Timothy V. Eley
*Assistant Examiner*—Frances Chin
*Attorney, Agent, or Firm*—Dykema Gossett

[57] ABSTRACT

A method and apparatus for forming pierce type or pierceless clinch joints in two sheets of material, such as sheet metal, employs a drive system which eliminates the need for camming mechanisms and periodic adjustment of worn cams. A die and anvil are relatively moveable and are displaced relative to a punch by means of a single drive lever which is driven by the output shaft of a hydraulic or pneumatic cylinder. A slide which drives the die is pivotally connected both to the drive lever and to a second slide which drives the anvil. The anvil slide is pivotally connected to the drive lever. The anvil and die are displaced in synchronism with each other and with the punch to form a clinch joint in a single workstroke of the cylinder motor.

4 Claims, 4 Drawing Sheets

METHOD AND APPARATUS FOR FORMING JOINTS

RELATED APPLICATIONS

This is a divisional application of U.S. patent application Ser. No. 071,451 filed July 8, 1987 now U.S. Pat. No. 4,856,316.

TECHNICAL FIELD

The present invention broadly relates to method and apparatus for forming joints between two sheets of material, and deals more particularly with a method and apparatus for mechanically forming so-called clinch joints between two sheets of material by mechanically deforming into interlocking relationship mutually opposing areas of the sheets.

BACKGROUND ART

In connection with many types of manufacturing processes, it is desirable, and sometimes required to join two sheets of material, by forming clinch joints therebetween. Clinch joints obviate the need for welding or special fasteners, are highly effective in holding two sheets of material together and can be formed using relatively simple apparatus. Clinch joints may be of the so-called pierce type in which one or both sheets of material are pierced in order to form an interlocking joint, or may be of the so-called waterproof type in which an interlocking joint is formed without piercing either sheet.

Apparatus for forming clinch joints, of both the pierced and non-pierced types, are well-known in the art. Such apparatus normally includes a punch for forming a cup in the two sheets of material, a die which cooperates with the punch to form the cup, and an anvil which cooperates with the punch to complete the deformation process. Previous types of known apparatus employ cams and/or various types of camming mechanisms to move the die, anvil and/or punch in synchronism with each other. Such types of apparatus are not only relatively difficult to manufacture, because in part they require trip levers to trip the cams, but also require frequent adjustment, especially under high production conditions, since cam wear results in deterioration of the quality of the clinch joint.

The present invention is intended to overcome the foregoing problems.

SUMMARY OF THE INVENTION

According to the present invention, a method and apparatus is provided for forming a clinch joint between two sheets of deformed material, such as sheet metal, for example. The invention eliminates the use of or need for a camming mechanism to sequentially displace an anvil and die relative to a punch in order to form the clinch joint. The apparatus includes a motor member consisting of a hydraulic or pneumatic cylinder having a reciprocable output shaft pivotally coupled to one end of a drive lever. The opposite end of the drive lever is pivotally connected to both an anvil driving slide which is drivingly connected to the anvil, and a pair of die slides which drive the die relative to the anvil. The die slides are disposed on opposite sides of the anvil slide, and are connected to the latter by means of a pivot pin which extends through an elongate slot in the anvil slide. The pivot pin in turn is pivotally connected to the drive lever. In the illustrated embodiment, the punch is stationarily mounted on a support and the die and anvil are reciprocated relative to the stationary punch. In a first portion of the workstroke, both the die and the anvil move downwardly toward the punch, with the two sheets of material positioned therebetwen. During this first portion of the workstroke, the die is spaced from the anvil in a direction of travel toward the punch, and functions to deform the two sheets of material over the punch to form a cup. During a second portion of the workstroke, the die retracts slightly while the anvil continues advancing toward the punch and eventually engages and forms the portion of the two sheets which defines the cup, so that at least sections of the deformed portions overlap each other to form a clinch joint. During a retraction workstroke, the anvil and die are retracted so that the finished clinch joint and sheets of material may be removed from the punch.

It is therefore a primary object of the invention to provide apparatus for forming clinch joints which obviates the need for cams, cam trip levers, and various types of cam adjustments heretofore required.

It is a further object of the present invention to provide apparatus as described above which is especially simple in construction and therefore economical to fabricate.

A further object of the invention is to provide apparatus as described above which may be employed to form either pierced or nonpierced type clinch joints.

A still further object of the invention is to provide apparatus as mentioned above which is relatively simple and light-weight, and is therefore relatively portable.

Another object of the invention is to provide a method of forming an improved clinch joint.

These, and further objects and features of the invention will be made clear or will become apparent during the course of the following description of a preferred embodiment of the present invention.

BRIEF DESCRIPTION OF THE DRAWINGS

In the drawings, which form an integral part of the specification and should be read in conjunction therewith, and in which like references numerals are employed to designate identical components in the various views.

DESCRIPTION OF THE PREFERRED EMBODIMENTS

Figure 1:
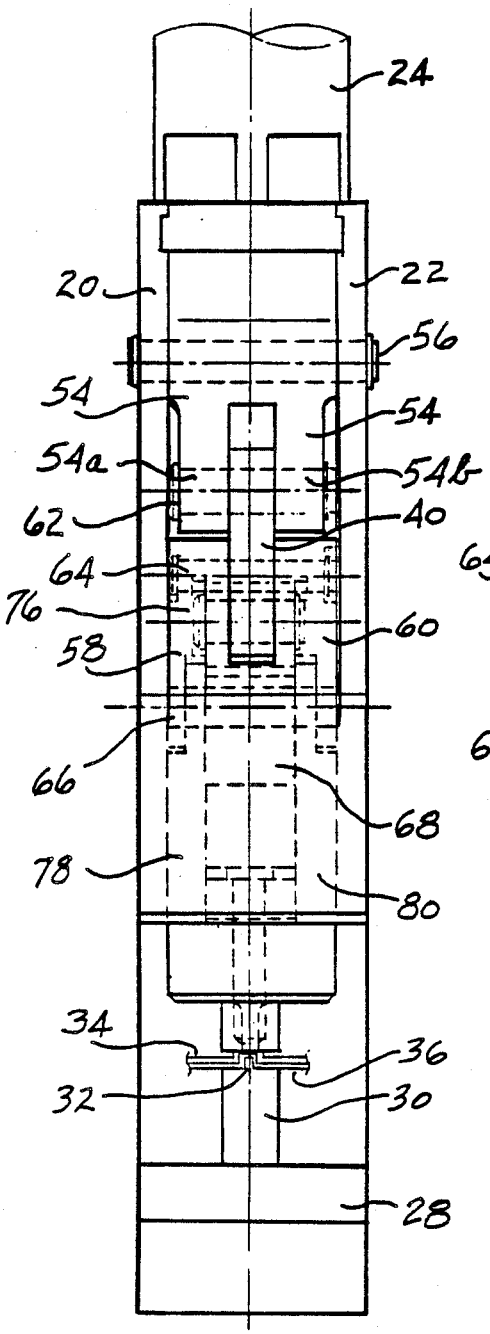
FIG. 1 is a front view of apparatus for forming clinch joints in accordance with the preferred embodiment of the present invention, a portion of the motor member being broken away in section.

Referring first to FIGS. 1 through 4, the present invention broadly relates to a method and apparatus for forming clinch joints between two sheets of deformable ductile material, such as sheet metal. A number of types of clinch joints can be formed using the method and apparatus of the present invention, however, for illustrative purposes, a so-called pierceless or waterproof type of clinch joint is formed, in which neither sheet of material is pierced.

The apparatus broadly includes a motor member 24, a pair of side plates 20, 22, and a punch support 28. The motor member 24 may be of a pneumatic or hydraulic type, consisting of a cylinder having a reciprocable output shaft 26. The motor member 24 operates a drive assembly, described below, which in turn shifts an anvil 86 and die 94 relative to each other, and toward and away from a punch 30, and particularly an upstanding punch element 32. The punch element 32 cooperates with the anvil 86 and die 94 to form the clinch joint, as will become apparent hereinbelow.

The reciprocable output shaft 26 is connected to one end of an elongate driver lever 40 by means of a clevis 38 having an elongated slot 44 therein, and a drive pin 42 which extends through a hole 46 in the drive lever 40 and the elongate slot 44 in the clevis 38. One end of the drive lever is thus pivotally connected to the outer end of the output shaft 26, and has its pivot point shiftable somewhat as a result of the elongate mounting slot 44. The opposite end of the drive lever 40 is provided with three apertures therein, 48, 50 and 52 respectively. The drive lever 40 is pivotally mounted between the plates 20, 22 by means of a clevis link 54 which includes a pair of connecting links 54*a*, 54*b*. The connecting clevis 54 is mounted between the two plates 20, 22 by means of a pivot pin 56. The lever 40 is connected to the connecting links 54*a*, 54*b* by means of a pivot pin 62.

An anvil slide 68 includes a pair of clevis-like ears 72 each provided with through holes 74. Ears 72 are pivotally mounted on drive lever 40 by means of pivot pin 76 which extends through holes 74 and aperture 52 in the drive lever 40. The anvil slide 68 includes a lower bearing portion 90 which engages and bears on the head 88 of a cylindrical shaft 84 which includes a reduced diameter portion defining the anvil 86. The anvil slide 68 also includes another through hole 70 therein which is elongated in the direction of the longitudinal axis of the anvil slide 68.

A pair of die slides 78, 80 are respectively mounted between opposite sides of the anvil slide 68, and the plates 20, 22. The die slides 78, 80 are each connected to a die 92. An anvil retainer 82 is secured to the anvil slide 68 and includes a through hole 83 therein, through which the cylindrical portion 84 of the anvil 86 extends. The die 92 has an apertured die button 94 through which the anvil 86 may extend. The die slide assembly, consisting of slides 78, 80, and die 92 is slideably shiftable relative to anvil slide 68 and anvil 86, toward and away from the punch 30 by means which will now be described. Each of two elongate connecting links 58, 60 is pivotally connected to the outermost end of drive lever 40 by means of a pivot pin 64 which extends through hole 50 in lever 40. The opposite ends of the connecting links 58, 60 are pivotally connected to the upper ends of die slides 78 and 80, by means of a pivot pin 66 which extends through the elongate clearance hole 70. It may thus be appreciated that the pivot point between the upper ends of the die slides 78, 80 and the connecting links 58, 60 is longitudinally slideable relative to the anvil slide 68, in the direction in which both the anvil slide 68 and the die slides 78 travel relative to the punch 30. The clearance hole 70 is provided merely to allow unimpeded shifting of the pivot pin 66.

Figure 4:
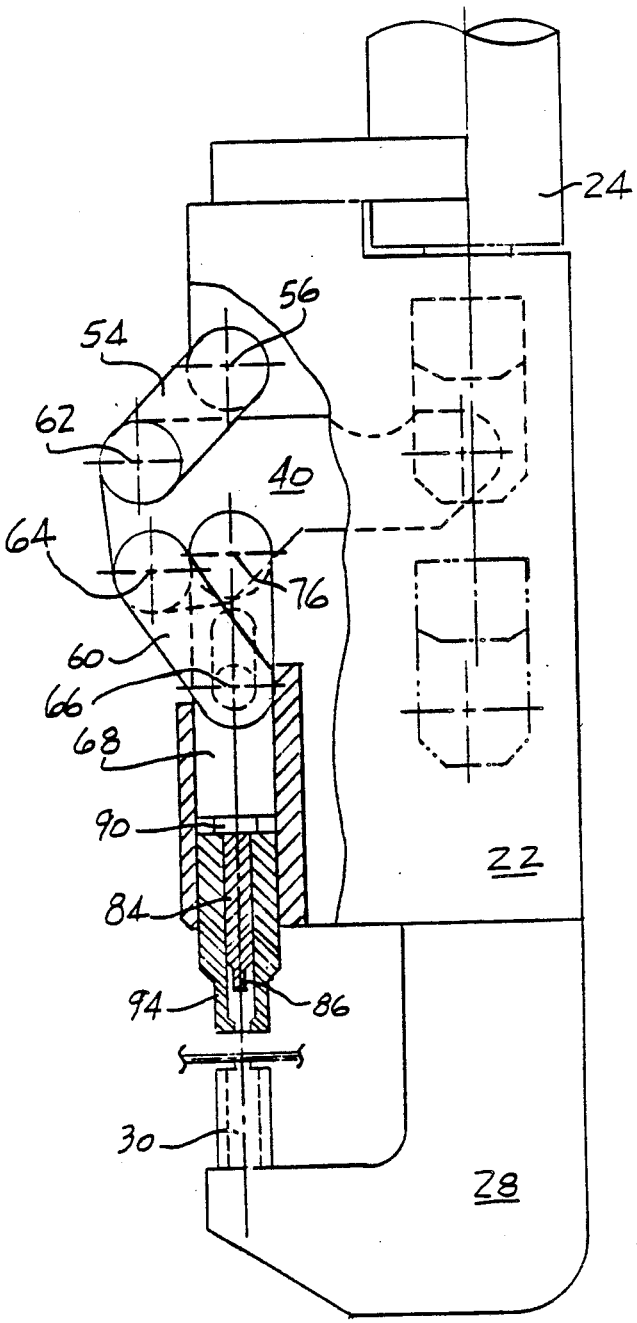
FIG. 4 is a view similar to FIG. 2 with portions broken away in cross-section for clarity, the drive mechanism, anvil and die being shown in the starting position before a clinch joint is formed.
Figure 5:
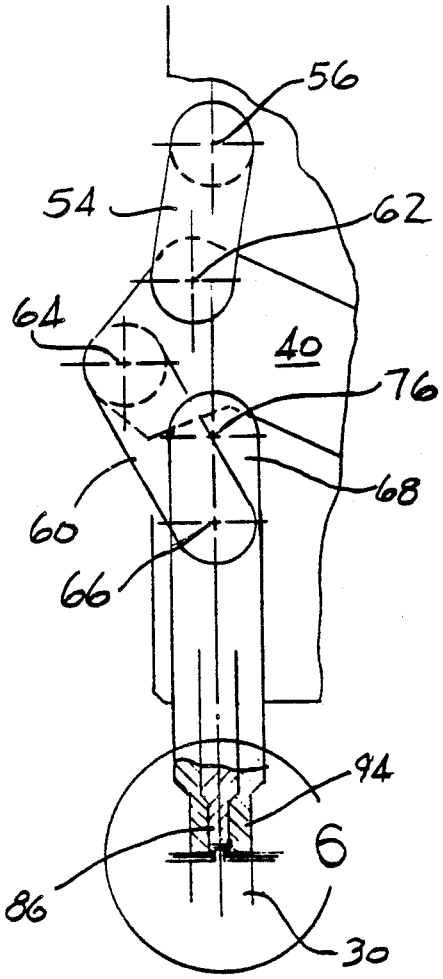
FIG. 5 is a side view depicting the relationships of the drive members, anvil and die, when the apparatus completes the first portion of the workstroke.
Figure 7:
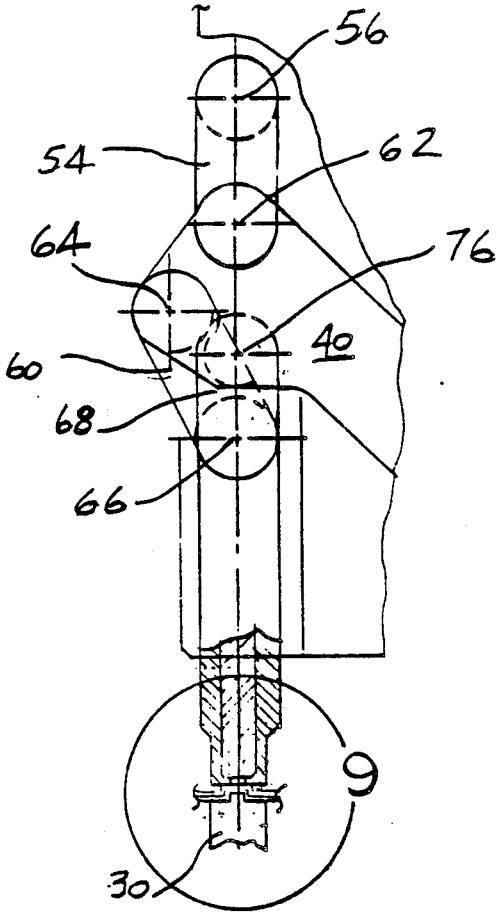
FIG. 7 is a view similar to FIG. 5, but depicting the relationship of the components when the apparatus has completed a second portion of the workstroke.
Figure 6:
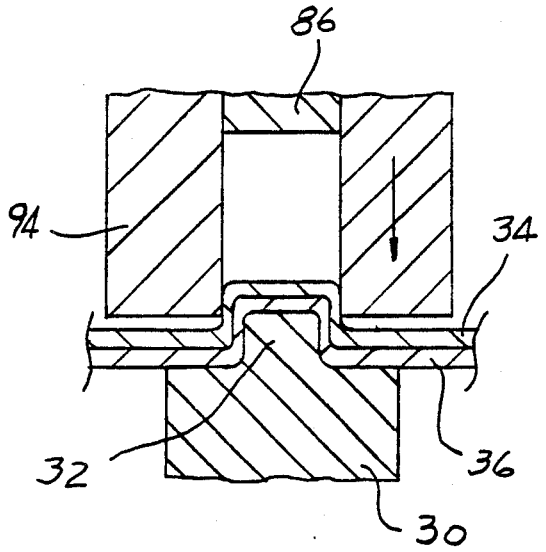
FIG. 6 is an enlarged, cross-sectional view showing the relationship of the die, anvil, punch and sheets of material immediately before the apparatus has completed the first portion of its workstroke.

Having described the construction of the apparatus, its method of operation will now be discussed, particularly with reference to FIGS. 4–10. In FIG. 4, the components of the apparatus are shown in their initial starting position, with the output shaft 26 retracted, immediately prior to commencement of a workstroke. With the components in this position, the anvil 86 and die 94 are retracted to their raised position, spaced from the punch 32 so that the overlapping sheets 34 and 36 may be placed therebetween. The motor member 24 is then actuated to commence a workstroke. During a first portion of the workstroke, drive lever 40 is driven by output shaft 26 and is caused to rotate in a clockwise direction, as viewed in FIGS. 4, 5 and 7. This clockwise rotation of the drive link 40 is guided in part by the connecting links 54 which connect the drive lever 40 to the stationary supporting structure. During this first portion of the workstroke, it can be seen that the pivot points (designated by the same numerals corresponding to the respective pivot pins) 64, 66 and 76 move downwardly, with the pivot pin 66 positioned near the bottom of the hole 70. Thus, during this first portion of the workstroke, both the die 94 and the anvil 86 move downwardly in unison with each other, with the anvil 86 spaced from the outer end of the die 94. As this first portion of the workstroke is completed, the lower end of the die 94 engages the top sheet 34 and deforms the two sheets 34, 36 over the punch element 32 to form a "cup" in the two sheets 34, 36.

Figure 8:
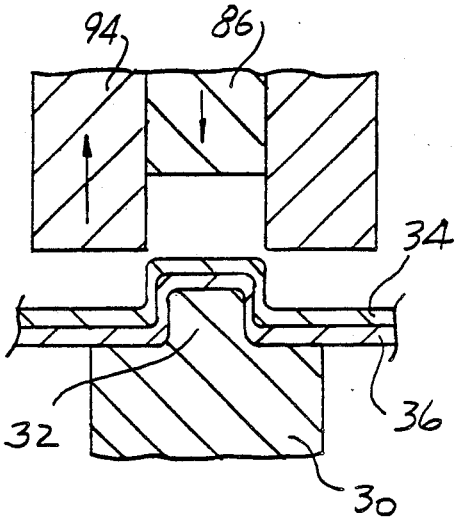
FIG. 8 is a view similar to FIG. 6, but depicting the relationship of the die and anvil when the apparatus has completed a second portion of its workstroke.
Figure 9:
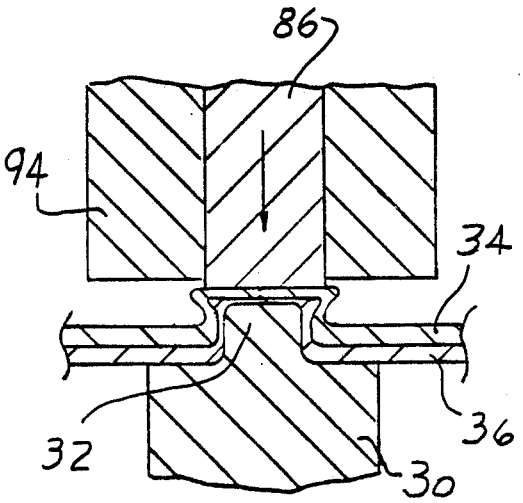
FIG. 9 is a view similar to FIG. 6, but depicting the relationship between the anvil and die when the apparatus has completed a third portion of its workstroke; and, FIG. 10 is a view similar to FIG. 9, but depicting a subsequent portion of the workstroke during the initial retraction of the die and anvil to their starting positions.

The output shaft 26 continues to move downwardly through a second portion of the workstroke, causing the drive lever 40 to continue to rotate in a clockwise direction. During this second portion of the workstroke, pivot point 64 rotates clockwise (FIGS. 5 and 7) and moves upwardly, thus, links 60 draw the die slides 78, 80 upwardly to retract the die 94 away from the sheets 34, 36. Simultaneously, continued clockwise motion of the drive lever 40 during the second portion of the workstroke drives pivot point 76 downwardly and therefore causes the anvil 86 to move toward the punch element 32, as shown in FIG. 8. As the second portion of the workstroke is completed (see FIGS. 7 and 9), the die is retracted above the outer end of the anvil 86, so that the anvil 86 engages and deforms a portion of the sheets 34, 36 in overlapping relationship to each other to form a joint therebetween. Notice that the periphery of the deformed material of the joint extends laterally outward beyond the sides of the anvil 86, in clearing relationship to the die 94. It should be noted here that, during the first portion of the workstroke, the die 94 is driven downwardly toward the punch 32 as a result of the lever 40 driving links 58, 60. However, during a later part of the second portion of the workstroke, continued clockwise motion of the drive lever 40 causes the pivot pin 66 to move upwardly within the hole 70, while at the same time, pivot pin 76 moves downwardly which in turn drives the anvil 86 toward the punch element 32.

Figure 2:
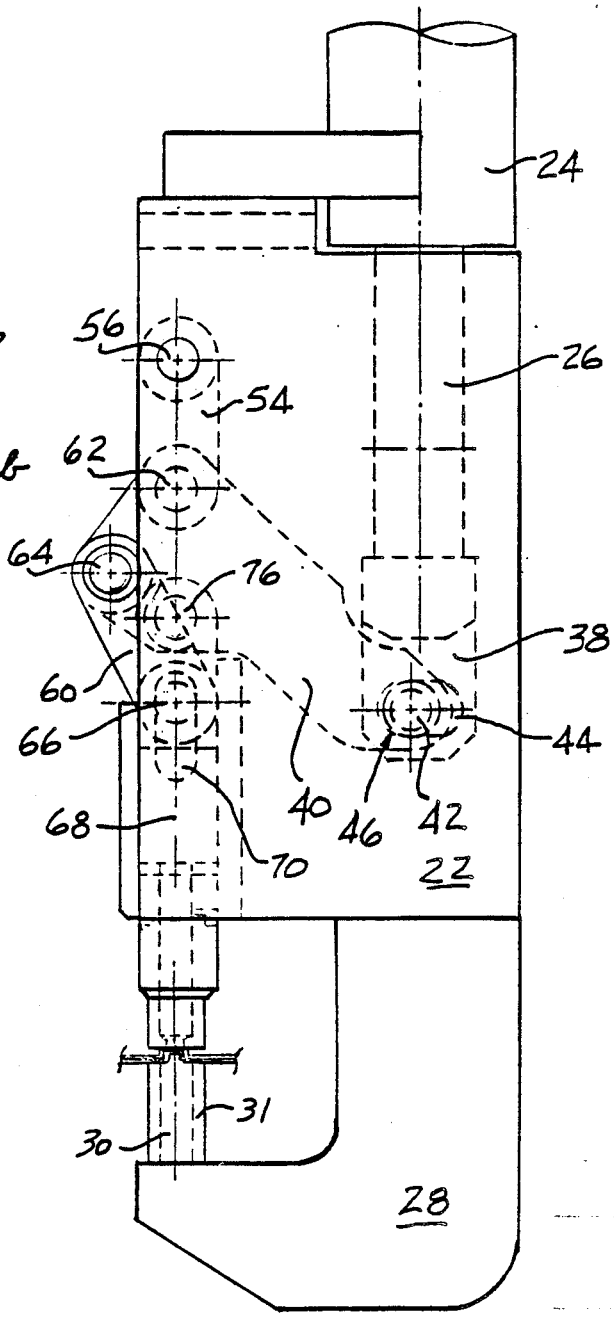
FIG. 2 is a side view of the apparatus shown in FIG. 1, the positions of the components depicted in FIGS. 1 and 2 corresponding to a third portion of the workstroke in which the anvil deforms a portion of the two sheets of material.
Figure 3:
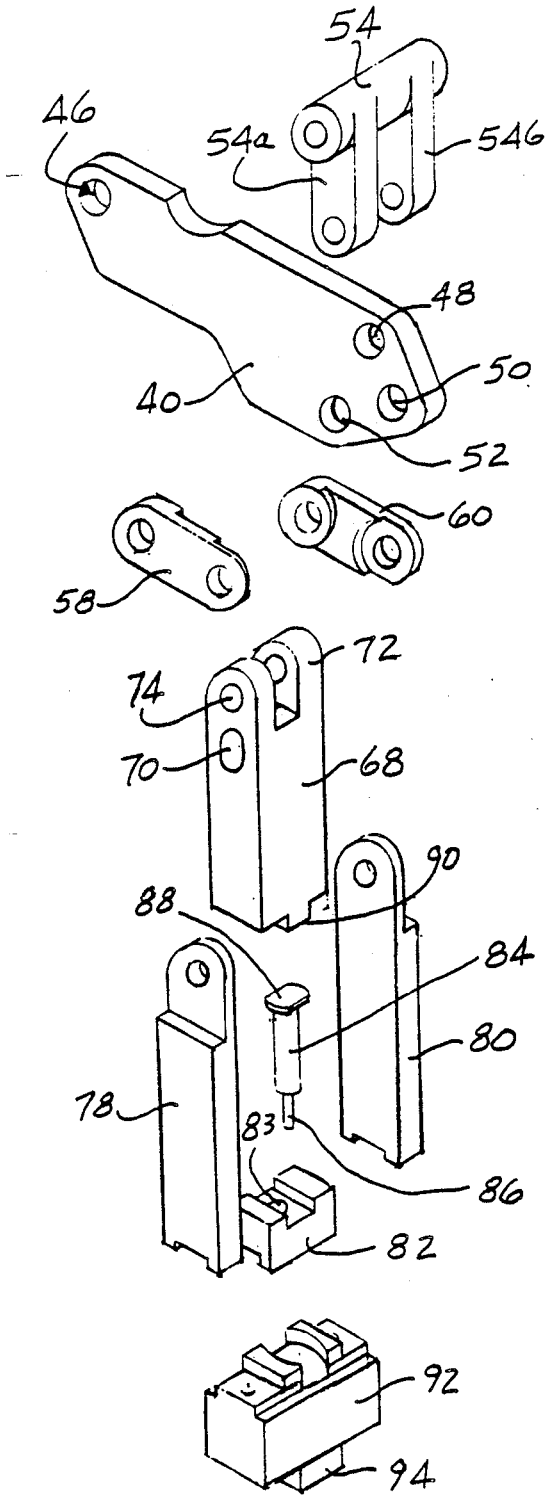
FIG. 3 is an exploded, perspective view of the primary components of the apparatus.
Figure 10:
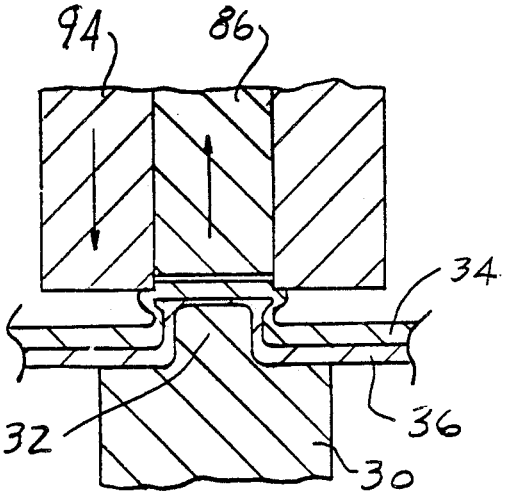

The positions of the parts during the first portion of the return stroke of the shaft 26 are depicted in FIG. 10. Initial reverse movement of the drive lever 40 in the counterclockwise direction results in the die 94 once again moving downwardly a short distance, while the anvil 86 moves upwardly. This results in a further deformation of the peripheral edges of the joint, as shown in FIG. 10 which increases the strength of the resulting clinch joint. During the final portion of the workstroke, the output shaft 26 is further retracted, causing both the anvil 86 and the die 94 to return to their starting position, depicted in FIG. 4. It should be noted here parenthetically that as shown in FIGS. 2 and 4, the punch 30 may be provided with an elastic, e.g. urethane, sleeve 31 which surrounds the punch and functions to eject the joint from the punch 30.

From the foregoing, it can be appreciated that the present invention not only provides for the reliable accomplishment of the objects of the invention but does so in a particularly effective and economical manner. It is recognized, of course, that those skilled in the art may make various modifications or additions to the preferred embodiment chosen to illustrate the invention without departing from the spirit and scope of the present contribution to art. Accordingly, it is to be understood that the protection sought and to be afforded hereby should be deemed to extend to the subject matter claimed and all equivalents thereof fairly within the scope of the invention.

What is claimed is:

1. A method of forming a clinch joint between two sheets of material, comprising the steps of:

(A) relatively displacing a die and a punch during a first portion of a workstroke to form a cup in a section of said sheets;

(B) relatively displacing the die and an anvil during a second portion of a workstroke to laterally deform peripheral portions of the sheet section defining said cup, the relative displacement of the die and anvil being sufficient to allow said peripheral portions to be displaced laterally beyond said anvil so that part of said laterally deformed portions overlap said die; and (C) relatively displacing the die and the anvil during a third portion of a workstroke to further deform said peripheral portions in the direction of displacement of said die.

2. The method of claim 1, wherein step (B) is performed by moving the anvil toward said sheets and moving the die away from and out of contact with said sheets.

3. The method of claim 2, wherein step (C) is performed after step (B) and includes the substeps of moving the die toward and into contact with said sheets from a position spaced from said sheets.

4. A method of forming a clinch joint between two sheets of material, comprising the steps of:

(A) relatively displacing a die and a punch during a first workstroke to form a cup in a section of said sheets;

(B) laterally deforming peripheral portions of the sheet section defining said cup during a second portion of a workstroke by moving an anvil toward said sheets and by moving the die away from and out of contact with said sheets; and (C) relatively displacing the die and the anvil during a third portion of a workstroke to further deform said peripheral portions in the direction of displacement of said die.

* * * * *